US008418877B2

(12) United States Patent
Phillips et al.

(10) Patent No.: US 8,418,877 B2
(45) Date of Patent: Apr. 16, 2013

(54) TODDLER CUP WITH ANGLED PARTITION

(76) Inventors: Shandley K. Phillips, San Diego, CA (US); Allyson L. Phillips, San Diego, CA (US)

( * ) Notice: Subject to any disclaimer, the term of this patent is extended or adjusted under 35 U.S.C. 154(b) by 566 days.

(21) Appl. No.: 12/149,023

(22) Filed: Apr. 25, 2008

(65) Prior Publication Data

US 2008/0264960 A1 Oct. 30, 2008

Related U.S. Application Data

(60) Provisional application No. 61/071,343, filed on Apr. 23, 2008, provisional application No. 60/914,007, filed on Apr. 25, 2007.

(51) Int. Cl.

| | |
|---|---|
| ***A47G 19/22*** | (2006.01) |
| ***B65D 25/04*** | (2006.01) |
| ***B65D 51/16*** | (2006.01) |
| ***B65D 83/00*** | (2006.01) |
| ***B65D 41/02*** | (2006.01) |
| *B65D 43/04* | (2006.01) |

(52) U.S. Cl.
USPC ..... 220/719; 220/713; 220/367.1; 220/555; 220/796; 220/717; 215/388; 215/230

(58) Field of Classification Search ..... 220/366.1, 220/253, 255, 703, 713, 719, 717, 553–554, 220/531, 529, 710, 555, 796, 798; 215/388, 215/DIG. 7, 387, 389, 230; 604/78; D9/738, D9/737; 206/459.5
See application file for complete search history.

(56) References Cited

U.S. PATENT DOCUMENTS

| | | | | |
|---|---|---|---|---|
| 1,941,327 | A * | 12/1933 | Turner | 215/6 |
| 4,928,848 | A | 5/1990 | Ballway | |
| 6,394,322 | B1 * | 5/2002 | Sekiya et al. | 222/465.1 |
| D504,049 | S * | 4/2005 | Morano et al. | D7/534 |
| 7,562,789 | B2 * | 7/2009 | Randolph et al. | 220/710.5 |
| 2002/0070225 | A1 | 6/2002 | Bergeron | |
| 2005/0011901 | A1 * | 1/2005 | Clements | 220/703 |

FOREIGN PATENT DOCUMENTS

| | | |
|---|---|---|
| DE | 3422441 A1 * | 12/1985 |
| EP | 1561406 | 8/2005 |
| WO | WO 2006/031116 | 3/2006 |
| WO | WO 2006/040543 | 4/2006 |

OTHER PUBLICATIONS

Unpublished U.S. Appl. No. 11/061,587, filed Feb. 22, 2005.

* cited by examiner

*Primary Examiner* — Robin Hylton
(74) *Attorney, Agent, or Firm* — Drinker Biddle & Reath LLP

(57) ABSTRACT

An improved spill-proof cup, such as a "sippy cup." The sippy cup has an internal partition that is angled toward the mouth of the sippy cup to decrease the amount of tilt required to dispense the entirety of the liquid from the sippy cup, thus improving comfort for the infant using the sippy cup while also teaching good drinking habits that can be applied to an adult type cup.

17 Claims, 13 Drawing Sheets

TODDLER CUP WITH ANGLED PARTITION

This application claims benefit from a U.S. Provisional Patent Application 61/071,343, entitled "IMPROVED SPILL-PROOF CUP," filed on Apr. 23, 2008, and from U.S. Provisional Patent Application Ser. No. 60/914,007, filed on Apr. 25, 2007, the entire contents of each being incorporated herein in their entirety.

BACKGROUND OF THE INVENTION

1. Field of the Invention

The present invention provides an improved spill-proof cup, commonly referred to as a "sippy cup." More particularly, the present invention provides a sippy cup having an internal partition that is angled toward the mouth of the sippy cup to decrease the amount of tilt required to dispense the entirety of the liquid from the sippy cup.

2. Description of the Related Art

Sippy cups are used to help transition babies from bottles to regular cups. Typically, the biggest challenge in transitioning babies to regular cups is teaching them to not dump the fluid all over themselves by tipping the cup as far back as the bottle, to which they have come accustomed, to empty the cup.

Sippy cups usually come in two varieties, a cup with lid and spout (sippy cup) to drink while tilted towards the mouth, or a cup with lid and straw to drink by sucking through the straw. One problem with the straw cup is it does not train the baby's motor skill habits to handle a regular cup. On the other hand, with the lid and spout sippy cup, the baby will usually tip the cup almost completely upside down and thus need to tip his or her head back to finish the fluid. This creates discomfort for the baby, and also provides no training for transition to using regular adult type cups.

Accordingly, a need exists for an improved sippy cup.

BRIEF DESCRIPTION OF THE DRAWINGS

These and other objects, advantages and novel features of the invention will be more readily appreciated from the following detailed description when read in conjunction with the accompanying drawings, in which.

DETAILED DESCRIPTION

Figure 1:
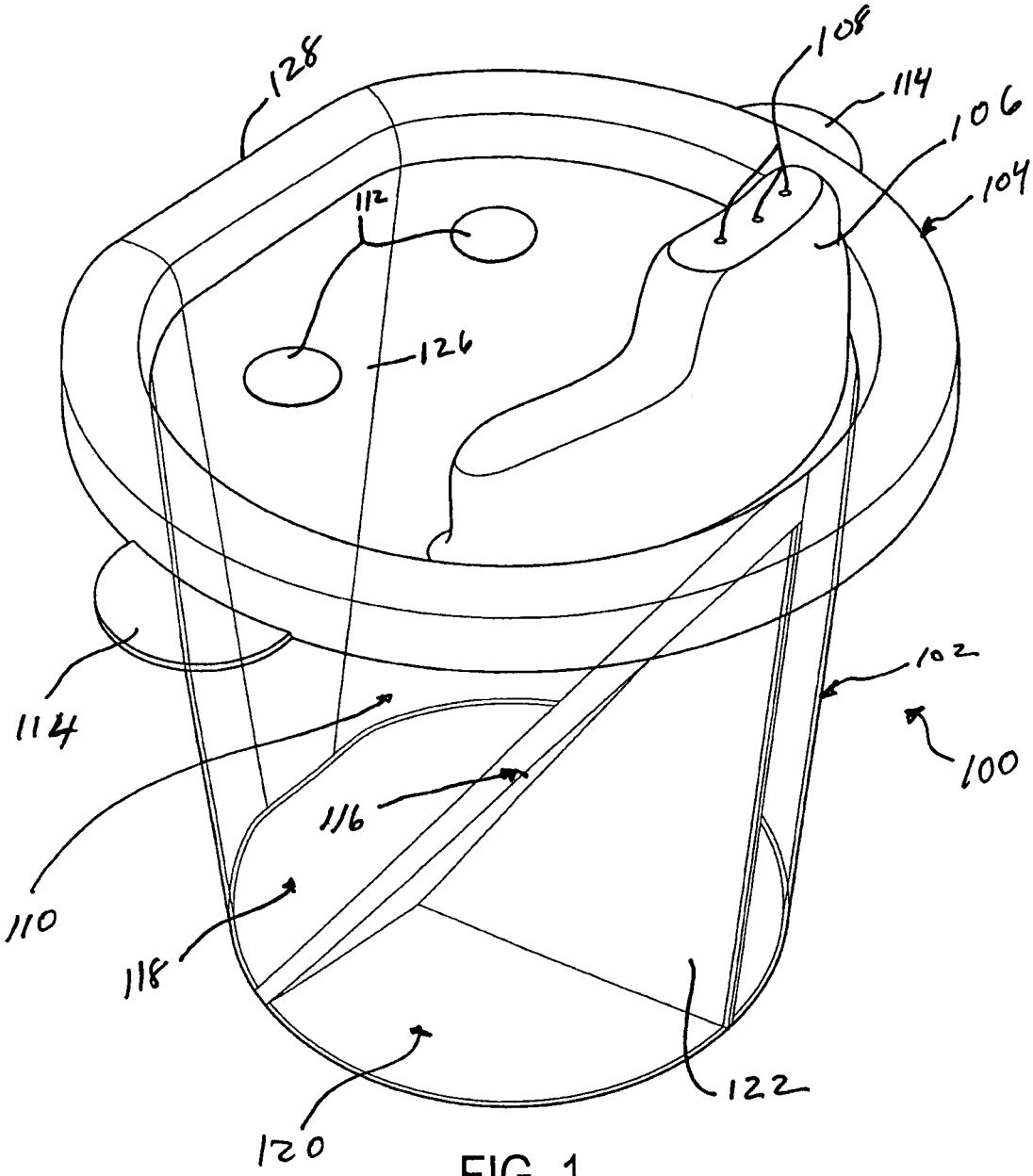
FIG. 1 is a perspective view illustrating an example of a sippy cup according to an embodiment of the present invention.
Figure 2:
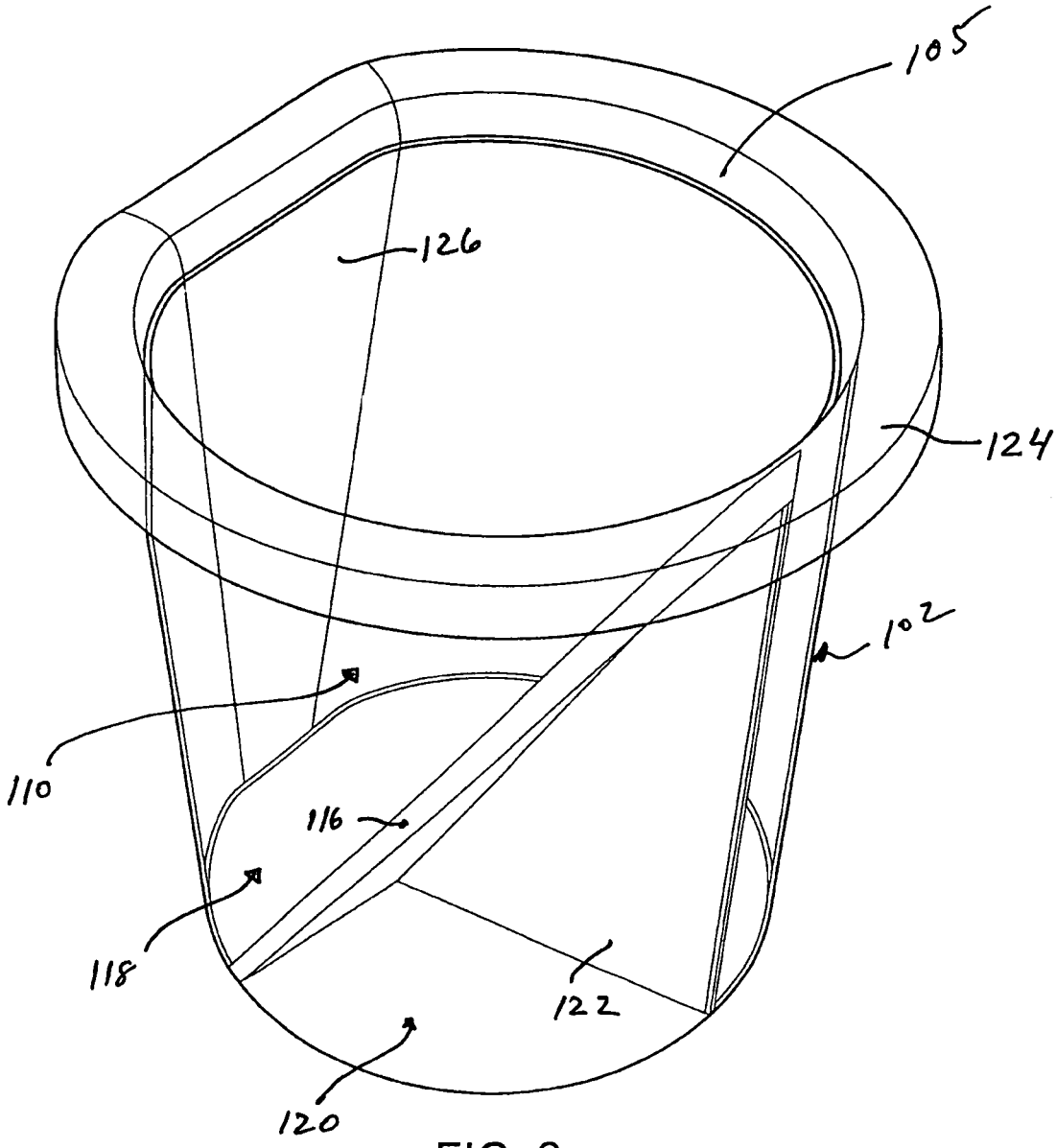
FIG. 2 is a perspective view of the sippy cup shown in FIG. 1 without its lid.
Figure 3:
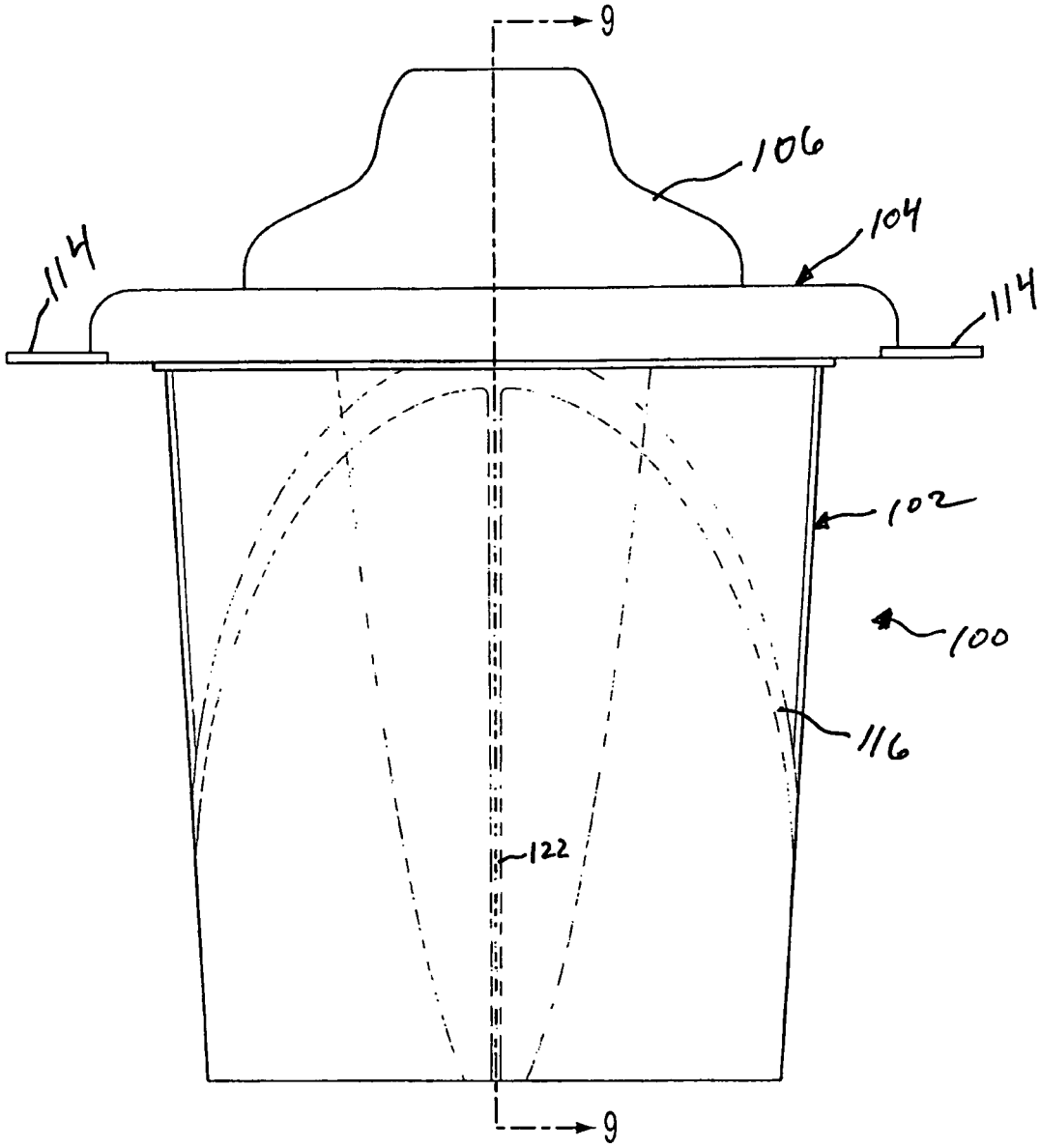
FIG. 3 is a side view of the sippy cup shown in FIG. 1 taken in a direction facing the side of the sippy cup along which the inclined internal partition is positioned.
Figure 4:
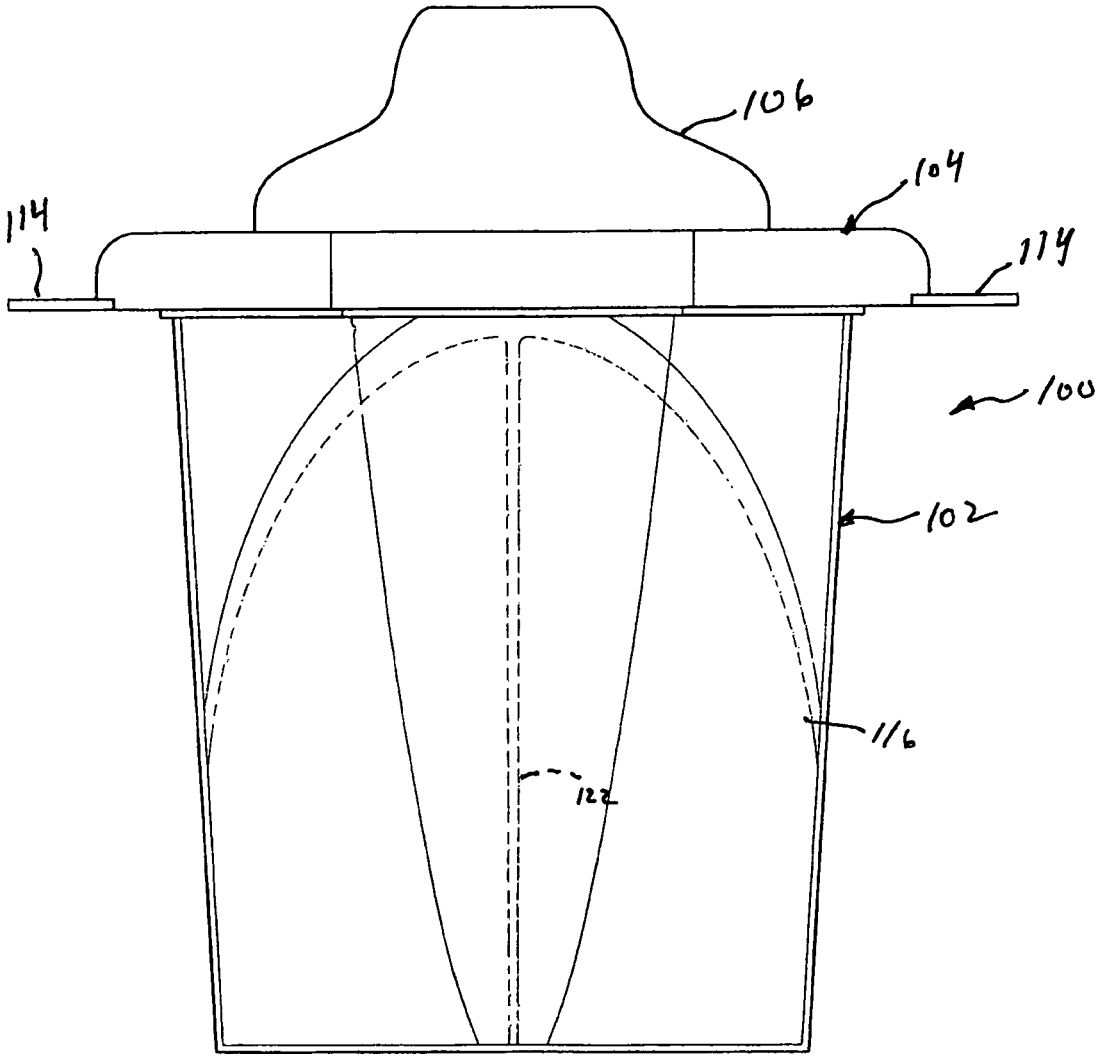
FIG. 4 is a side view of the sippy cup shown in FIG. 1 taking in a direction opposite to that of FIG. 3.

FIGS. 1-10 illustrate an example of a sippy cup 100 according to an embodiment of the present invention. As with conventional sippy cups, the sippy cup 100 includes a cup 102 and a cap 104. The cup 102 and cap 104 can be made of any suitable non-toxic, shatter-resistant material such as plastic, polycarbonate, polypropylene or the like, which can be clear, transparent or have any desired coloring.

The cap 104 can be snap-fit, screwed on, or removably coupled to the cup 102 over the top opening 105 in the cup 102 in any suitable manner. The cap 104 typically includes a mouthpiece 106 having one or more openings 108 therein which communicate with the interior chamber 110 of the cup 102. The cap 104 can further include one or more openings 112 therein which are in communication with the chamber 110 and allow, for example, air to enter the chamber 110 as fluid flows out of the openings 108, thus facilitating the flow of the fluid through the openings 108. As can be understood, the fluid can be any type of liquid that is typically consumed by a baby or infant, such as formula, milk, water, juice and so on. As further shown, the cap 104 can include handles 114 to assist in the removal of the cap 104 or to assist with handling of the sippy cup 100.

Figure 5:
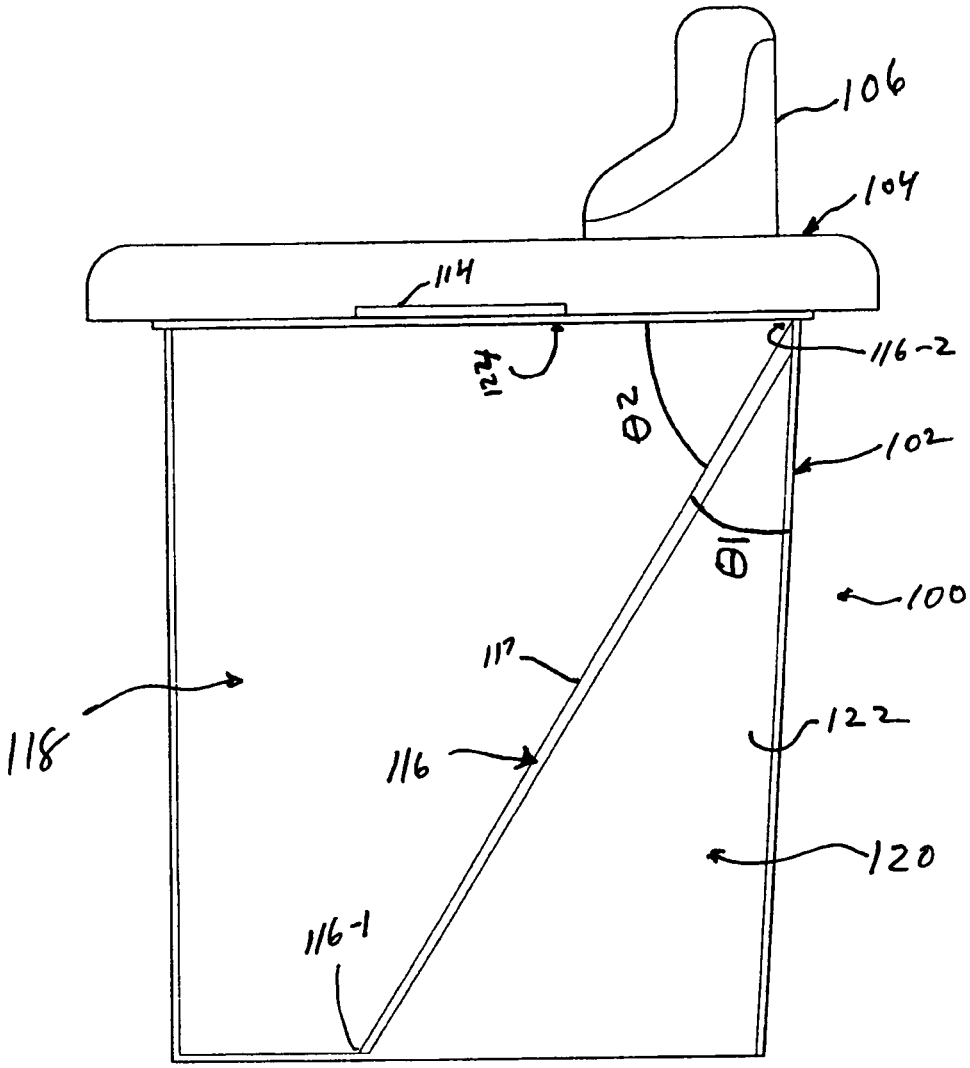
FIG. 5 is a side view of the sippy cup shown in FIG. 1 taken in a direction facing the side of the sippy cup transverse of the inclined internal partition.
Figure 6:
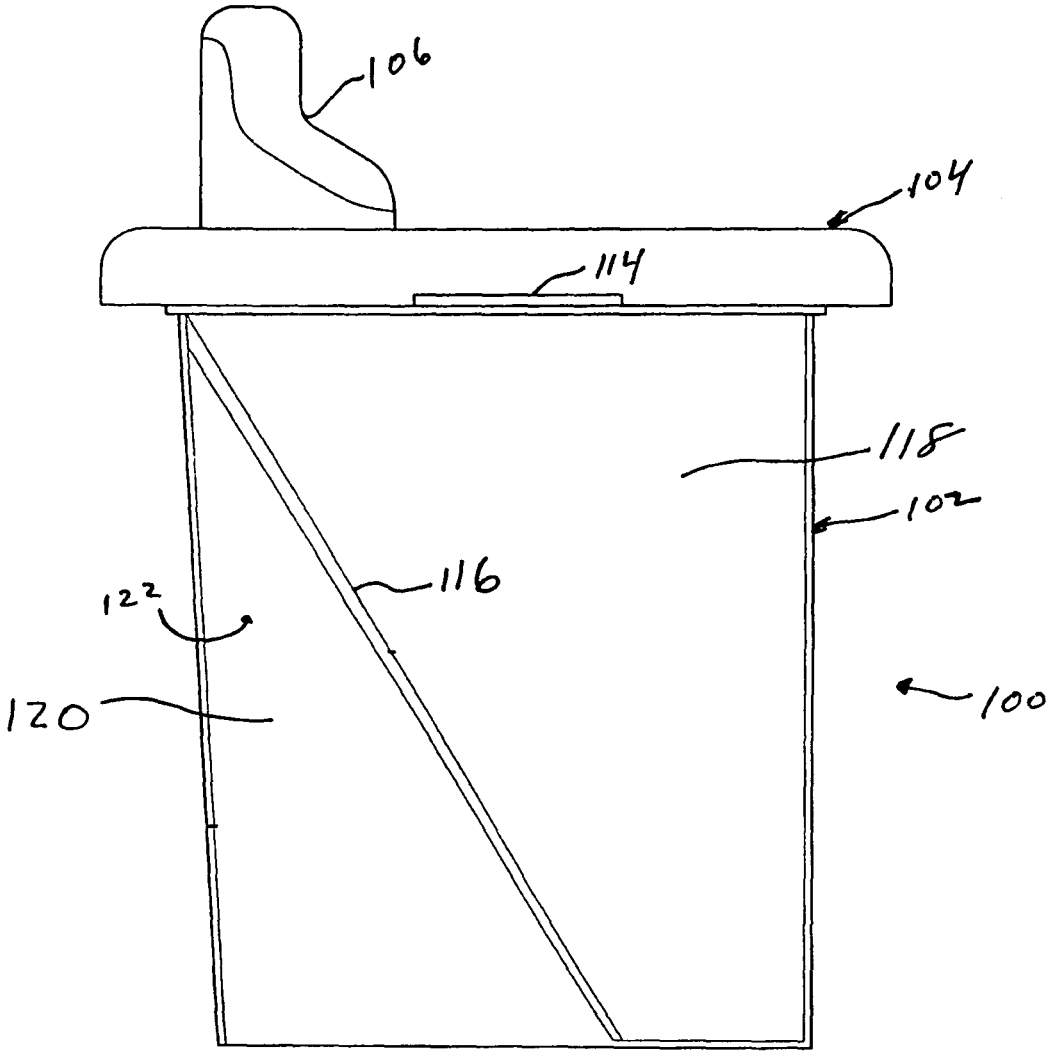
FIG. 6 is a side view of the sippy cup shown in FIG. 1 taken in a direction facing the side of the sippy cup opposite to that shown in FIG. 5.
Figure 7:
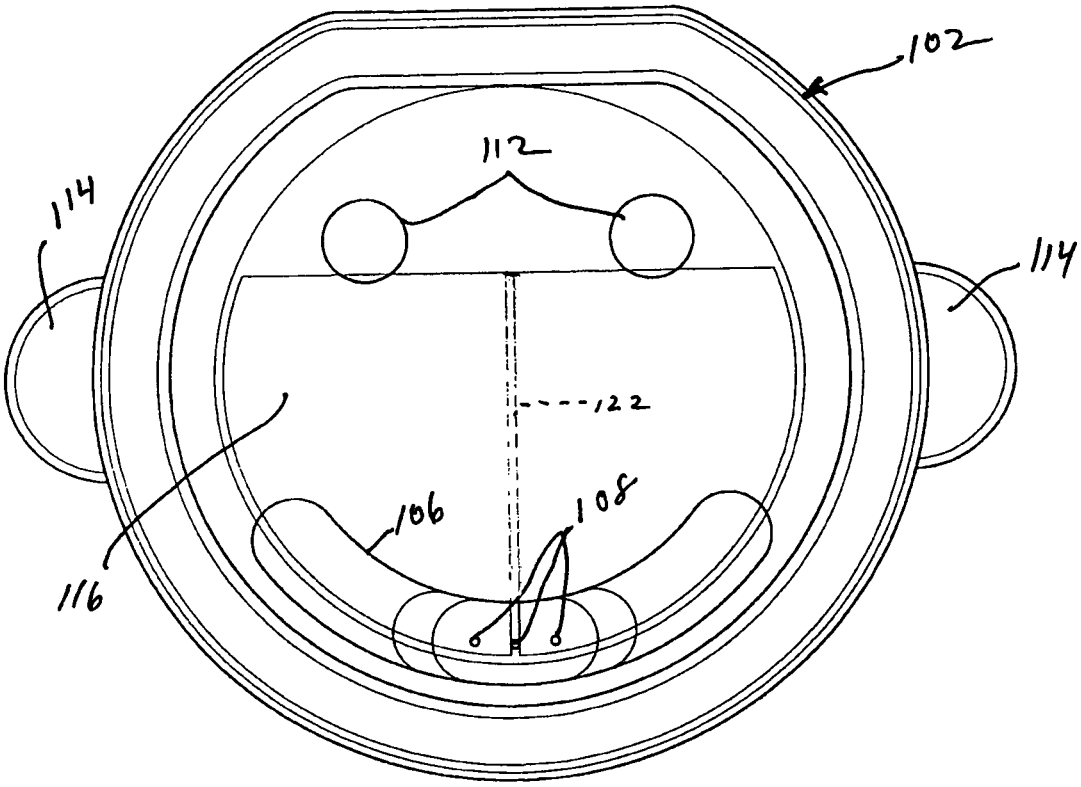
FIG. 7 is a top view of the sippy cup shown in FIG. 1.
Figure 8:
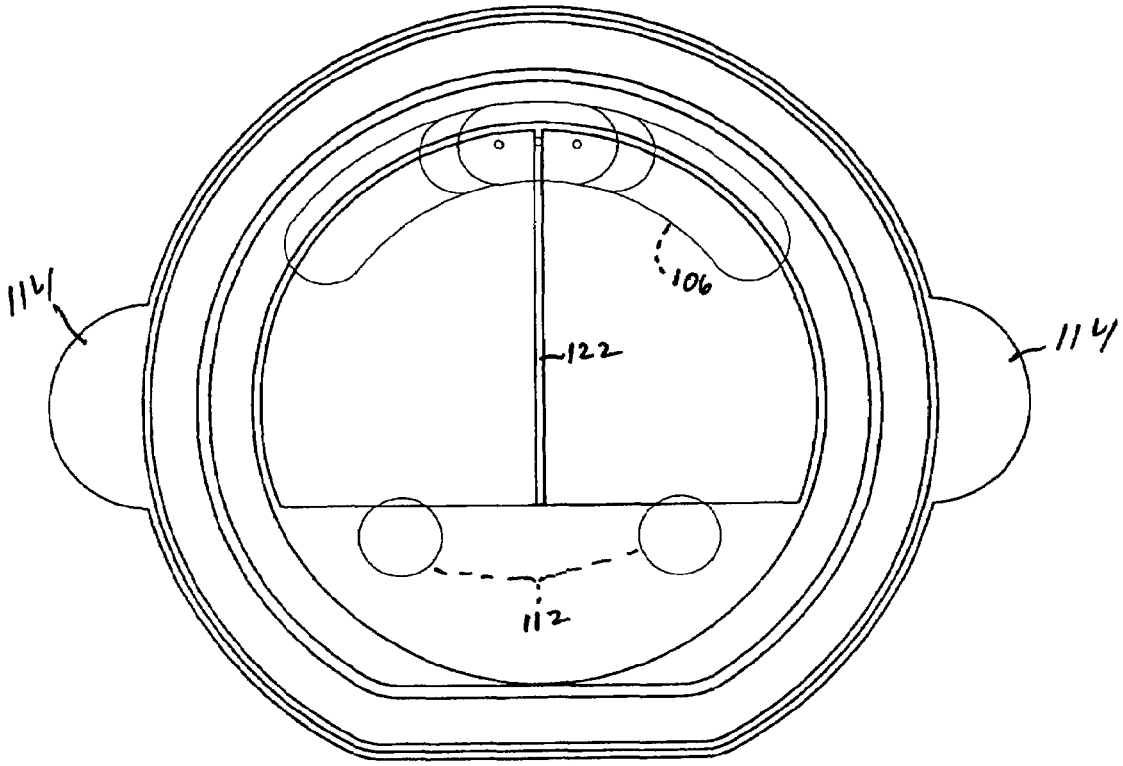
FIG. 8 is a bottom view of the sippy cup shown in FIG. 1.
Figure 9:
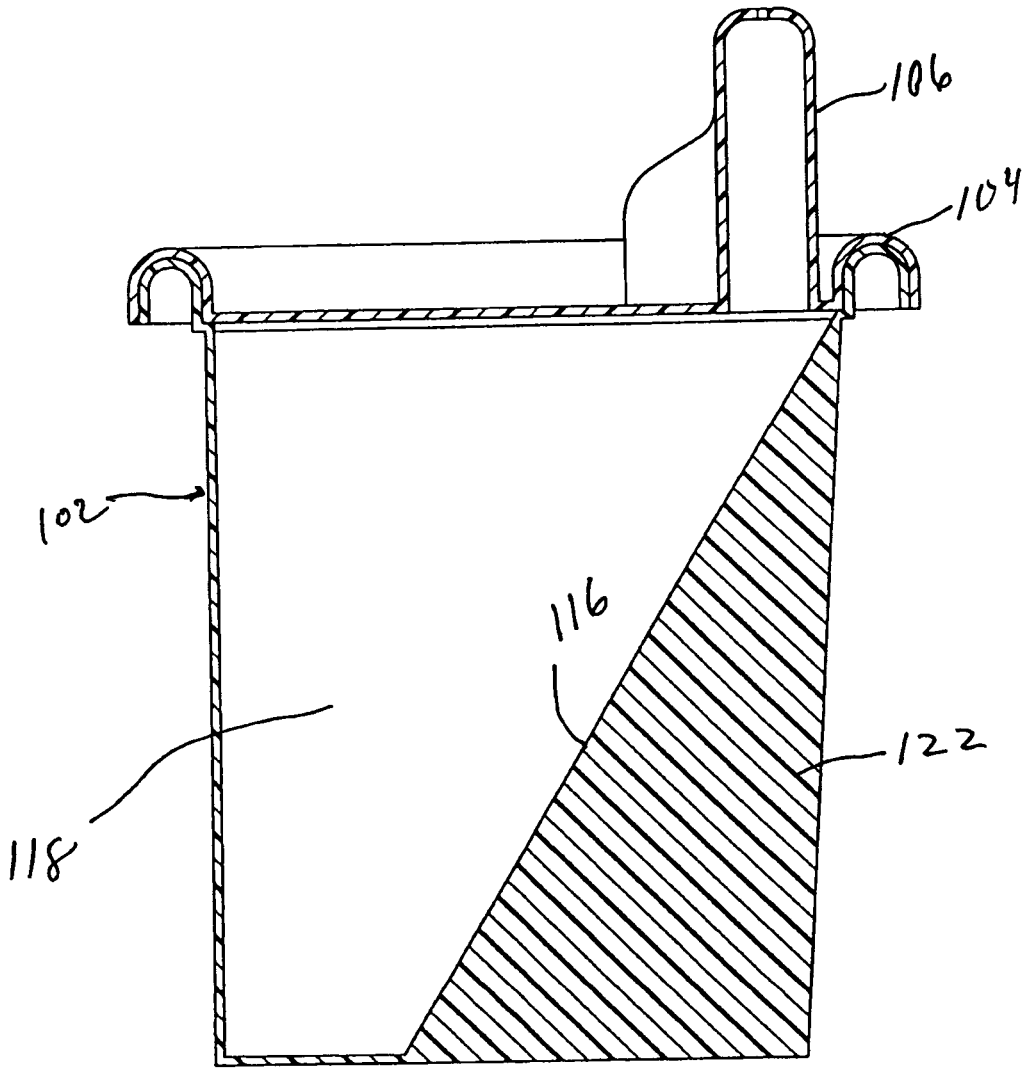
FIG. 9 is a cross-sectional view of the sippy cup shown in FIG. 1 taken along lines 9-9 as indicated in FIG. 3.

As shown in more detail in, for example, FIGS. 5, 6 and 9, the cup 102 further includes an angled partition 116 can be made, for example, of the same material as the cup 102. The angled partition 116 can be formed (e.g., molded) integral with the cup 102, or can be removably installed in the cup 102. The angled partition 116 has one end 116-1 that is integral with or connected to an inner bottom surface of the cup 102 and another end 116-2 that integral with or connected to an inner surface of the side wall of the cup 102 and is proximate to the top surface 124 of the cup 102. In either event, the angled partition 116 divides the chamber 110 into a fluid housing chamber 118 and one or more isolated chambers 120. The angled partition 116 can have, for example, one or more supports 122 as shown in FIG. 9 which provides added rigidity to the partition 116 and, along with the inner surface of the wall of the cup 102, define the isolated chambers 120. The isolated chambers 120 can be enclosed within the wall of the cup 102, or alternative can be open to the environment outside of the cup 102. For example, the bottom of the cup 102 below the isolated chambers 120 can be open so that the isolated chambers 120 vent into the outside environment, while still being isolated from the fluid housing chamber 118 inside the cup 102. Also, the isolated chambers 120 can be solid or substantially solid (e.g., completely or partially filled with the material with which the cup 102 is made).

Accordingly, when cap 104 is removed and fluid such as the type described above is placed (e.g., poured, taken from a faucet, etc.) into the chamber 110, the fluid is contained in the fluid housing chamber 118 and does not enter the isolated chamber 120. Hence, the isolated chamber 120 is isolated or substantially isolated from the fluid housing chamber 118. The top surface 117 of the angled partition 116 can be planar or substantially planar (e.g., flat or substantially flat), or can have any other suitable shape (e.g., a trough or groove-like shape) to facilitate flow of the liquid.

Figure 10:
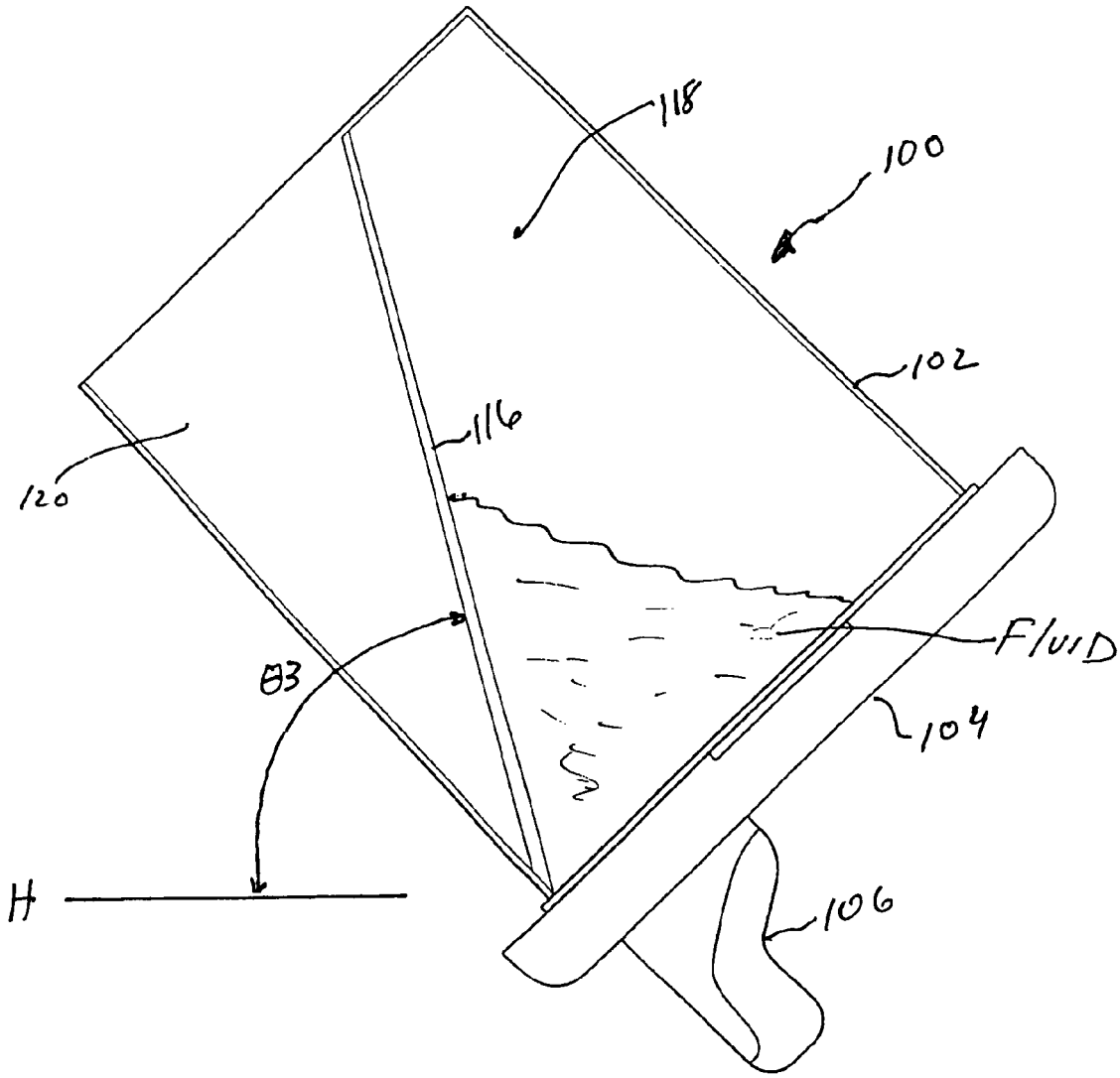
FIG. 10 is a side view of the sippy cup as shown in FIG. 5 tipped at an angle with respect to the horizontal.

As further shown in FIG. 5, the top surface 117 of the angled partition 116 is at an angle θ1 with respect to the wall of the cup 102, and thus is at an angle θ2 with respect to the top surface 124 of the cup 102 which defines the opening 105 in the cup 102. The angles θ1 and θ2 in this example are within any suitable ranges of degrees sufficient to enable the liquid in the fluid housing chamber 118 to flow along the top surface 117 of the angled partition 116 and out of the opening 105 in the cup 102 and ultimately out of the openings 108 in the mouthpiece 106 without having to tip the cup 102 upside-down, and more particularly, without having to tip the cup 102 much if any amount of degrees beyond the horizontal as shown in FIG. 10. For instance, the angle θ1 and θ2 each be at or about 45 degrees, or within any other suitable range of angles (e.g., θ1 can be within at or about 30 degrees to 60 degrees with θ2 being at a corresponding angle of at or about 90 degrees minus θ1). As can be appreciated, as the height of the cup 102 increases with respect to the diameter if the cup, a smaller angle for θ1 may be sufficient to achieve the desired flow.

It also be should be noted that the wall of the cup 102 need not be normal (e.g., at or about 90 degrees) with respect to the top surface 124 of the cup 102, but can be slanted or have curves or recesses for ease of handling or design. For instance, the cup 102 can have one or more flattened areas 126, and the cap 104 can likewise have one or more flattened areas 128, to insure that when the cap 104 is placed on the cup 102, the mouthpiece 106 is positioned with respect to the angled partition 116 as shown in the figures so as to maximize the effectiveness of the angled partition 116 with regard to fluid flow as discussed above. For example, as shown in FIG. 1, the openings 108 are aligned such that a line passing through the center opening 108 in a direction parallel to the longitudinal axis of the cup passes through a central portion of the partition 116 when the cap 104 is coupled to the cup 102.

Figure 11:
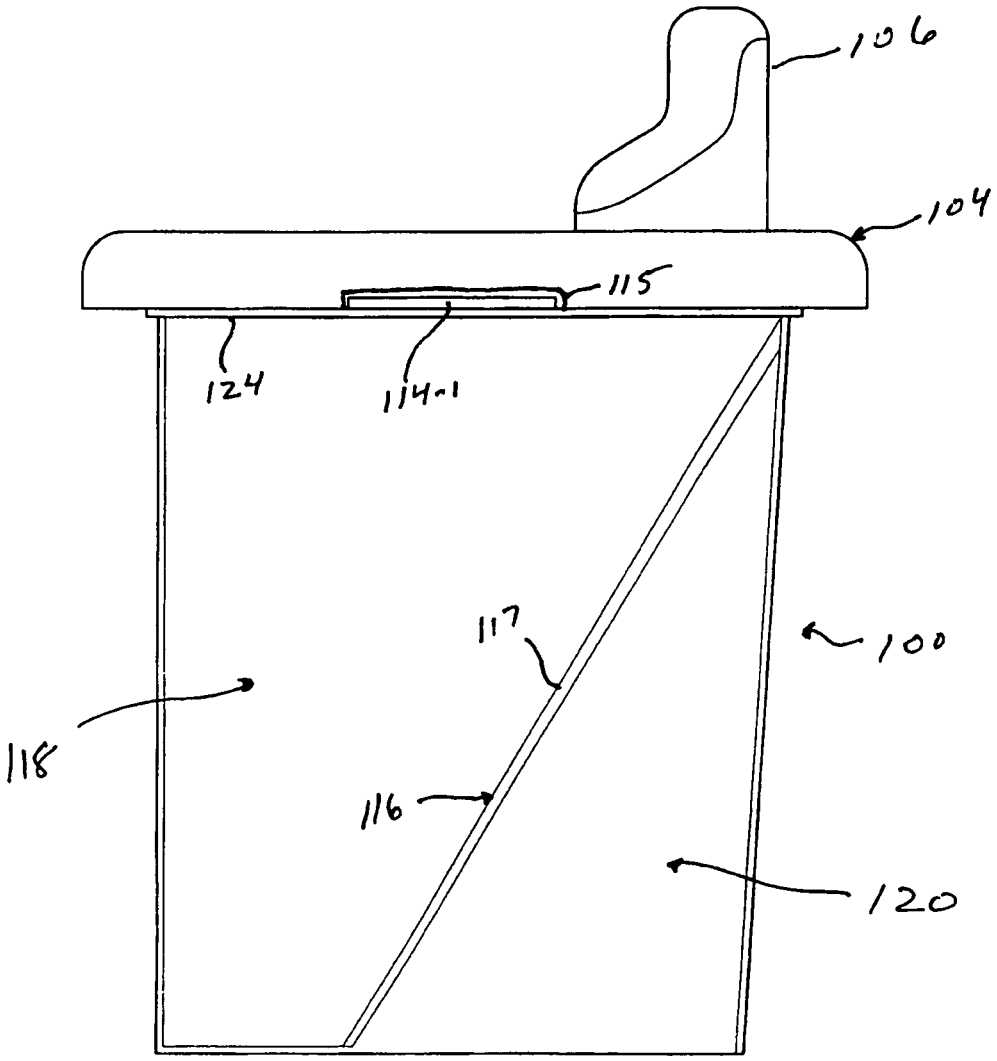
FIG. 11 is a side view of an example of a variation of the sippy cup as shown in FIG. 1.

Alternatively, the cup 102 can be cylindrical or substantially cylindrical, and the cap 104 can likewise be round or substantially round, in which even the cap 104 can have an alignment notch therein and the cup 102 can have an alignment groove therein, or vice-versa, to insure that when the cap 104 is placed on the cup 102, the mouthpiece 106 is positioned with respect to the angled partition 116 as shown in the figures so as to maximize the effectiveness of the angled partition 116 with regard to fluid flow as discussed above. For example, as shown in FIG. 11, the one or more handles 114-1 (e.g., tabs) can be made present at the top of the cup 102 (instead of on the cap 114 as in FIG. 1) and thus one or more corresponding notches 115 can be in the cap 104 to insure that when the cap 104 is placed on the cup 102, the mouthpiece 106 is positioned appropriately with respect to the angled partition 116 as discussed above. Alternatively, an area by the top surface 124 of the cup 102 can include threads, which can engage with threads inside the portion of the cap 104 that mates with the cup 102, such that when the cap 104 is screwed completely or substantially completely onto the cup 102, the mouthpiece is positioned appropriately with respect to the angled partition 116 as discussed above.

Accordingly, as can be appreciated from the above, when a baby, for example, tips the sippy cup 100 to drink from the sippy cup 100, the surface 117 of the partition 116 will facilitate flow of the liquid to the mouthpiece 116. Due to the presence of partition 116, the sippy cup 110 can be emptied, or at least substantially emptied, when the sippy cup 100 is tilted so that the surface 117 of the partition 116 is at an angle θ3 which can be substantially zero degrees with respect to the horizontal H or any suitable degree with respect to the horizontal H which is sufficient to enable the liquid in the fluid housing chamber 118 to flow along the top surface 117 of the angled partition 116 and out of the opening 105 in the cup 102 and ultimately out of the openings 108 in the mouthpiece 106 without having to tip the cup 102 upside-down, and more particularly, without having to tip the cup 102 much if any amount of degrees beyond the horizontal. Therefore, the baby need not tip the sippy cup 100 substantially vertical to empty the sippy cup 100. Hence, the sippy cup 100 provides improved comfort for the baby since the baby need not tip his or head as far back as with a typical sippy cup to empty the sippy cup, and also help to teach the baby good drinking habits which can be applied to an adult type cup.

Figure 12:
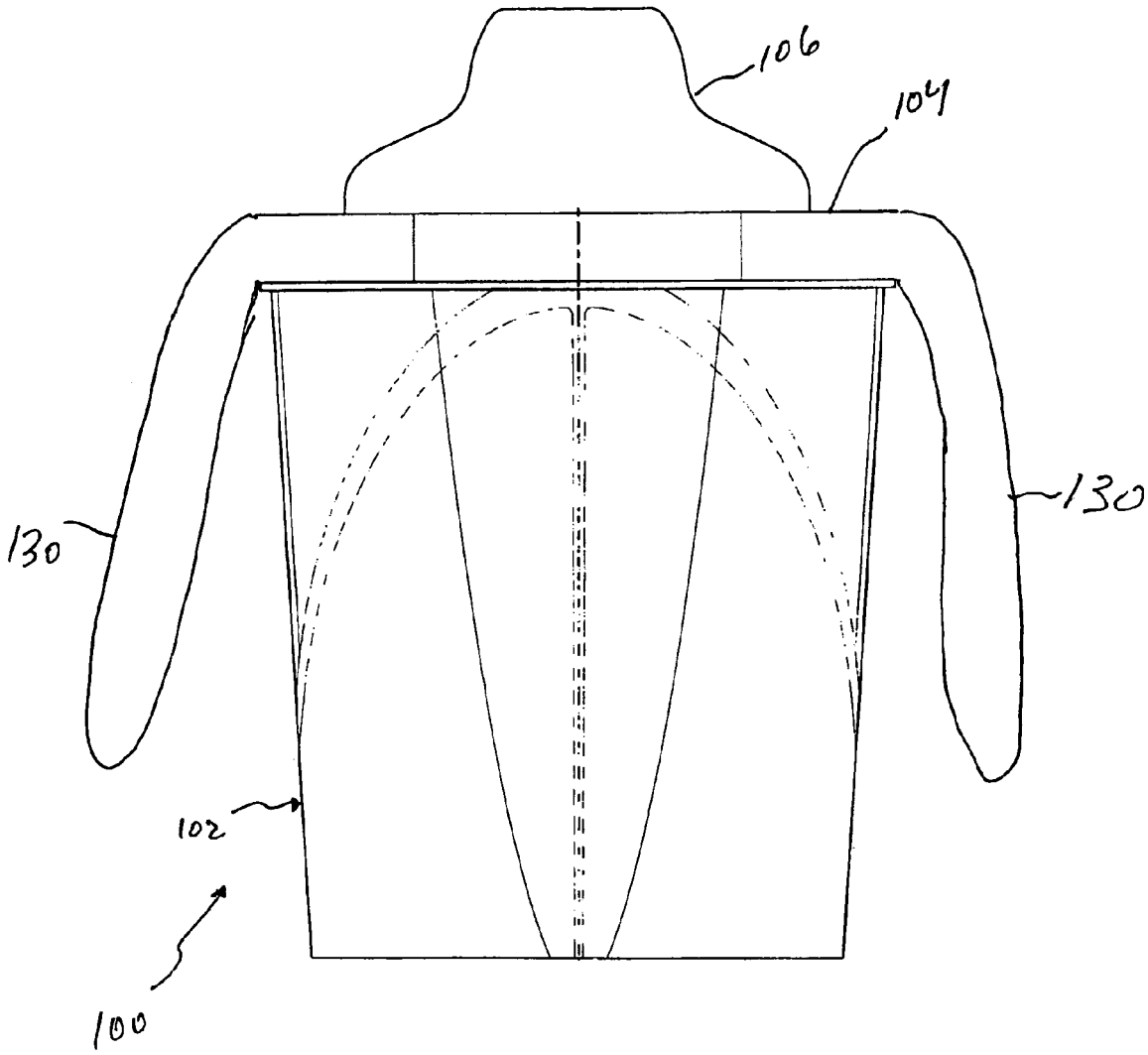
FIG. 12 is a side view of an example of another variation of the sippy cup as shown in FIG. 1.
Figure 13:
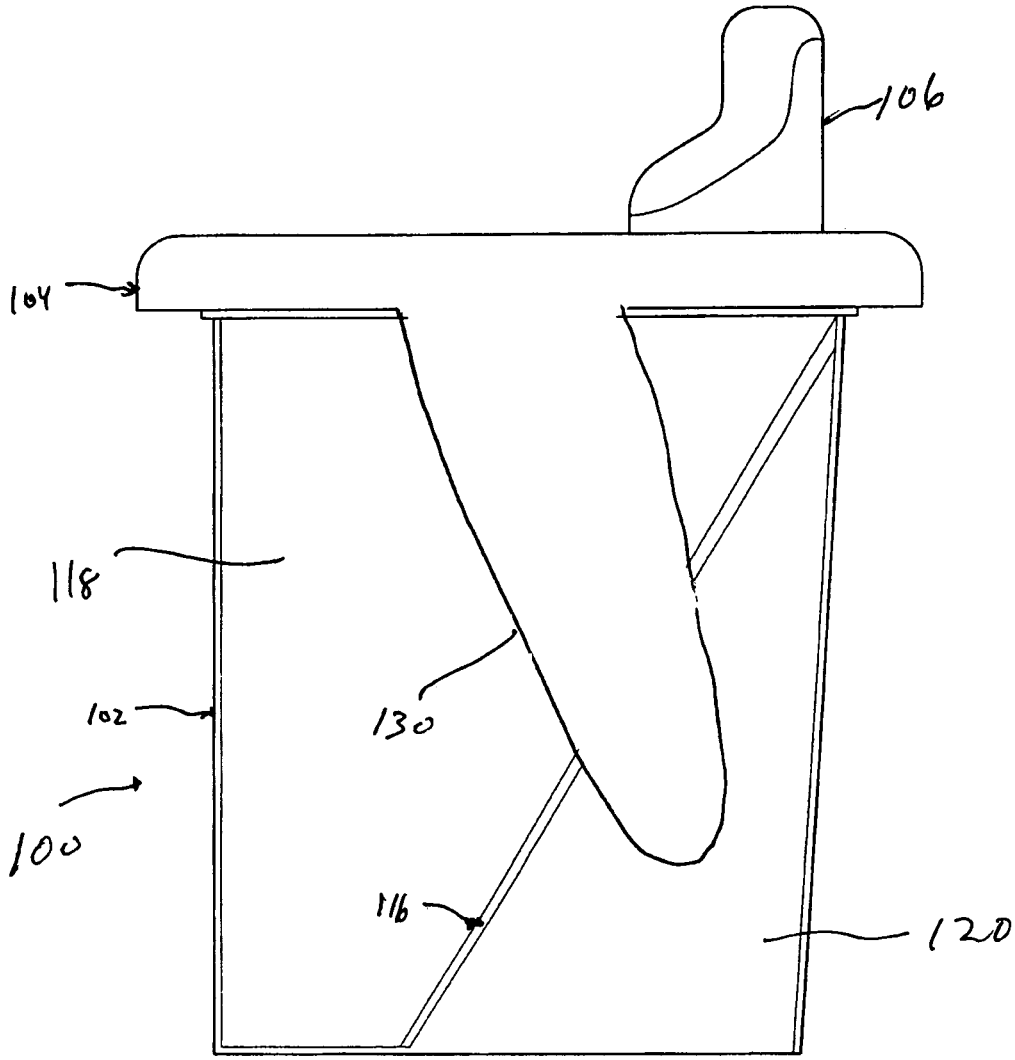
FIG. 13 is a side view of the variation of the sippy cup as shown in FIG. 12 taken in a direction facing the side of the sippy cup along which the inclined internal partition is positioned.

As can further be appreciated from the above, the sippy cup 100 can include additional features or enhancement that can improve its use. For instance, as shown in FIGS. 12 and 13, the cap 104 can include larger handles 130 that that baby can use to better handle the sippy cup 100.

While this invention has been particularly shown and described with reference to preferred embodiments thereof, the preferred embodiments described above are merely illustrative and are not intended to limit the scope of the invention. It will be understood by those skilled in the art that various changes in form and details may be made therein without departing from the spirit and scope of the invention as defined by the appended claims.

What is claimed is:

1. A sippy cup comprising:

a cup having a wall having an interior surface and forming an interior chamber and an upper surface defining an opening in communication with the interior chamber, wherein the interior surface of the wall of the cup is at an angle of 90 degrees or less with respect to the upper surface;

a partition, disposed in the interior chamber of the cup, to divide the interior chamber into at least one fluid housing chamber for receiving fluid therein and at least one isolated chamber that is isolated from the fluid received in the fluid housing chamber, said partition having a surface which defines a portion of the fluid housing chamber and is positioned at an angle with respect to the wall of the cup, to facilitate flow along the surface to the opening in the cup when the cup is positioned at an angle with respect to horizontal; and a cap, removably coupled to the cup, and having an upwardly extending mouthpiece having at least one opening therein that is in communication with the opening in the cup, such that the surface of the partition facilitates flow through the opening in the cup to the mouthpiece and through the opening in the cap when the cup is positioned at the angle with respect to horizontal, wherein the partition extends and maintains the angle with respect to the wall of the cup to the upper surface of the cup such that the at least one isolated chamber is closed at the upper surface of the cup, and wherein said at least one isolated chamber is open to an atmosphere outside of the cup.

2. A sippy cup comprising:

a cup having a wall having an interior surface and forming an interior chamber and an upper surface defining an opening in communication with the interior chamber, wherein the interior surface of the wall of the cup is at an angle of 90 degrees or less with respect to the upper surface;

a partition, disposed in the interior chamber of the cup, to divide the interior chamber into at least one fluid housing chamber for receiving fluid therein and at least one isolated chamber that is isolated from the fluid received in the fluid housing chamber, said partition having a surface which defines a portion of the fluid housing chamber and is positioned at an angle with respect to the wall of the cup, to facilitate flow along the surface to the opening in the cup when the cup is positioned at an angle with respect to horizontal;

a cap, removably coupled to the cup, and having an upwardly extending mouthpiece having at least one opening therein that is in communication with the opening in the cup, such that the surface of the partition facilitates flow through the opening in the cup to the mouthpiece and through the opening in the cap when the cup is positioned at the angle with respect to horizontal; and at least one support between the wall of the cup and the partition, wherein the partition extends and maintains the angle with respect to the wall of the cup to the upper surface of the cup such that the at least one isolated chamber is closed at the upper surface of the cup.

3. The sippy cup as claimed in claim 2, wherein the partition, an inner surface of the wall of the cup, and the support define a plurality of isolated chambers.

4. The sippy cup as claimed in claim 2, further comprising an alignment mechanism, configured to align the opening in the cap at a position such that the opening in the cap is substantially aligned with a center portion of the partition when the cap is coupled to the cup.

5. The sippy cup as claimed in claim 4, wherein the alignment mechanism comprises a flattened area on the cup and a flattened area on the cap, configured to mate with the flattened area on the cup when the cap is coupled to the cup, to align the opening in the cap with the partition.

6. The sippy cup as claimed in claim 4, wherein the alignment mechanism comprises at least one tab extending from the cup and at least one notch in the cap which mates with the at least one tab to align the opening in the cap with the partition.

7. The sippy cup as claimed in claim 2, wherein the partition has a first end that is integral with an inner bottom surface of the cup and a second end that is integral with an inner side surface of the cup at the upper surface of the cup.

8. The sippy cup as claimed in claim 2, wherein the cap further comprises handles.

9. The sippy cup as claimed in claim 2, wherein the surface of the partition is substantially planar.

10. The sippy cup as claimed in claim 2, wherein the surface of the partition maintains from the bottom of the cup to the upper surface of the cup a constant angle with respect to the upper surface of the cup.

11. The sippy cup as claimed in claim 2, wherein the surface of the partition is positioned at an angle such that the surface facilitates flow of substantially all of the fluid through the opening in the cup when the cup is positioned at the angle with respect to horizontal.

12. A sippy cup comprising:

a cup having a wall having an interior surface and forming an interior chamber and an upper surface defining an opening in communication with the interior chamber, wherein the interior surface of the wall of the cup is at an angle of 90 degrees or less with respect to the upper surface;

a partition, disposed in the interior chamber of the cup, to divide the interior chamber into at least one fluid housing chamber for receiving fluid therein and at least one isolated chamber that is isolated from the fluid received in the fluid housing chamber, said partition having a surface which defines a portion of the fluid housing chamber and is positioned at an angle with respect to the wall of the cup, to facilitate flow along the surface to the opening in the cup when the cup is positioned at an angle with respect to horizontal;

a cap, removably coupled to the cup, and having an upwardly extending mouthpiece having at least one opening therein that is in communication with the opening in the cup, such that the surface of the partition facilitates flow through the opening in the cup to the mouthpiece and through the opening in the cap when the cup is positioned at the angle with respect to horizontal;

at least one support between the wall of the cup and the partition, configured such that the partition, an inner surface of the wall of the cup, and the support define a plurality of isolated chambers; and an alignment mechanism, configured to align the opening in the cap at a position such that the opening in the cap is substantially aligned with a center portion of the partition when the cap is coupled to the cup, wherein the partition extends and maintains the angle with respect to the wall of the cup to the upper surface of the cup such that the at least one isolated chamber is closed at the upper surface of the cup.

13. The sippy cup as claimed in claim 12, wherein the surface of the partition is substantially planar.

14. The sippy cup as claimed in claim 12, wherein said at least one isolated chamber is open to an atmosphere outside of the cup.

15. The sippy cup as claimed in claim 12, wherein the alignment mechanism comprises a flattened area on the cup and a flattened area on the cap, configured to mate with the flattened area on the cup when the cap is coupled to the cup, to align the opening in the cap with the partition.

16. The sippy cup as claimed in claim 12, wherein the alignment mechanism comprises at least one tab extending from the cup and at least one notch in the cap which mates with the at least one tab to align the opening in the cap with the partition.

17. The sippy cup as claimed in claim 12, wherein the partition has a first end that is integral with an inner bottom surface of the cup and a second end that is integral with an inner side surface of the cup at the upper surface of the cup.

* * * * *